US006137096A

United States Patent [19]

Seo

[11] Patent Number: 6,137,096

[45] Date of Patent: Oct. 24, 2000

[54] DOOR LATCHING MECHANISM WITH OPENING DELAY

[75] Inventor: Dong Wan Seo, Changwon, Rep. of Korea

[73] Assignee: LG Electronics Inc., Seoul, Rep. of Korea

[21] Appl. No.: 09/191,378

[22] Filed: Nov. 13, 1998

[30] Foreign Application Priority Data

Nov. 15, 1997 [KR] Rep. of Korea ..... 97-60247

[51] Int. Cl.[7] ..... H05B 6/68

[52] U.S. Cl. ..... 219/722

[58] Field of Search ..... 219/722–724

[56] References Cited

U.S. PATENT DOCUMENTS 5,036,179 7/1991 Westerberg et al. .
5,478,986 12/1995 Westerberg .
5,517,005 5/1996 Westerberg et al. .
5,620,624 4/1997 Westerberg .
5,695,669 12/1997 Westerberg .
5,712,464 1/1998 Westerberg .
5,726,423 3/1998 Westerberg et al. .
5,736,713 4/1998 Westerberg .

*Primary Examiner*—Teresa Walberg
*Assistant Examiner*—Jeffrey C Pwu

[57] ABSTRACT

This invention relates to an opening and closing apparatus for a door of a microwave oven which has lighting lamps. The door of the microwave oven is devised to have a predetermined time until it is opened in a course of power transmission by a driving motor by which the door is opened and closed. The driving motor rotates a driving gear and the driving gear makes an opening and closing lever move linearly. Accordingly the door which is locked with the main body of microwave oven can be opened by the linear motion of the opening and closing lever. Therefore, the door is opened after a predetermined time is passed by the fact that the power transmission from driving motor is delivered to the opening and closing lever through the driving gear so that the remaining light by the lighting lamps can be completely removed. This can prevent the user's eye being damaged by the remaining light and improve the value in use for the microwave oven with lighting lamps.

10 Claims, 3 Drawing Sheets

DOOR LATCHING MECHANISM WITH OPENING DELAY

BACKGROUND OF THE INVENTION

1. Field of the Invention

This present invention relates to an opening and closing apparatus for a microwave oven door, and more particularly to an apparatus for delaying the opening of the door for a predetermined time to protect the user's eyes from the remaining light of the lighting lamps mounted in the microwave oven.

2. Description of the Related Art

Various devices and systems for cooking apparatus have been provided up to now. Basically, the oldest heating device was known as a specific container directly contacting a heating source, with food or the like therein to which heat was applied to cook the food or the like therein.

Thereafter, cooking apparatuses using electrical energy directly or indirectly have been developed. An example is a microwave oven using microwave energy as a heating source.

A microwave oven generates microwave energy from electricity. The microwave energy impinges into the food or the like, causing molecular motion in the interior of the food, thereby heating it. The microwave oven is widely used for thawing frozen food or heating food like milk to a desired degree because of simplicity in use.

However, the microwave oven has some disadvantages caused by its manner of heating food, and it has some limits on its own heat generating capacity as well. So, it is not always appropriate for heating food. The conventional microwave oven cannot provide a good quality of cooking with rapidity because it uses only microwave energy as a heating source, that is, a single way of heating by microwave and a certain limited output of power.

For example, when food is heated by microwave energy, it is done advantageously at once internally and externally, yet this advantage turns out to be a relative disadvantage depending on the food being heated. Food like pizza is particularly difficult to cook well with microwave energy only because of its nature. Also, heating with microwave energy may remove too much water from food.

An oven related to the microwave oven has been known to make use of a different heating source. It is now in common use.

Concretely speaking, this modified microwave oven additionally includes a heater to generate heat in its interior from another heating source apart from microwaves, by which it can appropriately heat various kinds of food.

However, it is also true that the modified microwave oven does not include various functions on the whole because said heater, even in the modified microwave oven having a heater, functions just as a simply additional heating source.

As stated above, when only microwave energy is used as a heating source, several disadvantages are exposed. These disadvantages include a single way of heating by microwave, a weakness in generating power, and too much evaporation of water from the food. Also, the provision of another heater cannot solve those problems in general even when it is mounted inside of the microwave oven, since it simply serves as an additional heat source.

Unlike conventional microwave ovens as mentioned above, another cooking apparatus simply using radiant energy as the sole heating source was disclosed in U.S. Pat. No. 5,517,005, dated May 14, 1996, for "Visible light and infra-red cooking apparatus" to Westerberg et al. This cooking apparatus is able to heat the inside and outside of food appropriately by impinging high-intensity visible and infra-red light rays upon food.

The door of the conventional microwave oven contacts a pair of switches connected in parallel for disconnecting the power supply of the microwave oven when the door is opened to prevent damage from the leakage of microwave energy.

But in the microwave oven having lighting lamps, light generated out of the lighting lamps do not go off instantaneously, so light remains inside for a certain period of time. Accordingly, in the case of the microwave oven having lighting lamps, it is necessary to protect the eyes of the user from the remaining light from the lighting lamps.

As shown in FIG. 1 which illustrates a conventional door of a microwave oven, latch member 3 has latch hooks 3*a*, 3*b* located at upper and lower regions of latch member 3 inside the main body 2 of the door. Latch member 3 is elastically biased by a spring 7. The latch board 5 has lockers 5*a*, 5*b*, which receive and engage latch hooks 3*a*, 3*b*, respectively, and is mounted in front of the microwave oven.

A pair of the door switches 4*a*, 4*b* which are switched on/off according to the engagement of latch hooks 3*a*, 3*b* around the lockers 5*a*, 5*b*, respectively.

FIG. 1 indicates that the door 2 is closed as biased downward by resilient force of the spring 7. The latch board 5 is arranged at the front of the microwave oven, which is engaged with the latch hooks 3*a*, 3*b*, respectively. The door switches 4*a*, 4*b* adjacent to the lockers 5*a*, 5*b* are turned on by contacting the latch hooks 3*a*, 3*b*.

With the door 2 closed, current is applied to the magnetron (not shown) which generates microwaves in accordance with an activation state of said door switches 4*a*, 4*b*, which are turned to on by the latch hooks 3*a*, 3*b*, so that food in the oven is cooked.

From this state, when the user pulls the door handle 1, the latch hooks 3*a*, 3*b* are disengaged from the lockers 5*a*, 5*b*, and the latch hooks 3*a*, 3*b* turn off the door switches 4*a*, 4*b*. In this way, when either of the door switches 4*a*, 4*b* is off, the supply of the current to the magnetron for generating microwave energy is cut off, since the door switches 4*a*, 4*b* are electrically connected in parallel.

However, in the conventional apparatus, the door 2 can open the moment the latch hooks 3*a*, 3*b* are released. The current supplied into the microwave oven is cut off the moment the door opens, and microwaves are not generated.

But the lighting lamps inside of the oven remain illuminated for about 2 seconds even if the current is off, when the door 2 opens. As a result the user may be inconvenienced by being blinded the moment the door is opened.

SUMMARY OF THE INVENTION

An object of the invention is to provide an opening and closing mechanism for a microwave oven door that delays the opening of the door until light in the oven is fully extinguished.

To achieve the above object, the opening and closing mechanism includes a locking mechanism for locking the door to the main body of the microwave oven, a releasing mechanism releasing the door, and a delaying mechanism for delaying the opening of the door for a predetermined time after the door is released by the releasing mechanism.

According to this invention, delaying the door opening for a predetermined time with such a delaying mechanism can solve the problem of the user being blinded by the light of lighting lamps inside of the microwave oven.

The opening and closing mechanism of the present invention further includes a switching mechanism for cutting off current to the microwave oven when the door is released by the releasing mechanism. By this switching mechanism, the instant the door is opened, the supply of current to the microwave oven is cut off. Therefore, the leakage of microwave energy is prevented.

The locking mechanism includes a latch member supported elastically on the door downward and a locker mounted at the front of the microwave oven to the hook latch.

The releasing mechanism includes an opening and closing level to move the latch towards being released from the locker.

The switching mechanism includes a pair of switching elements connected in parallel. The switching mechanism is on when the latch is locked on the locker, and it is off when the latch is detached from the locker.

The delaying mechanism includes a driving motor and a transmission that changes the power of the driving motor into the movement of the opening and closing lever.

The transmission comprises a driving gear rotated by the driving motor and a rack formed at one side of the opening and closing lever. The power of the driving motor is transmitted to the rack through the driving gear. Meanwhile, the opening time of the door is delayed until the opening and closing lever completely moves the latch.

BRIEF DESCRIPTION OF THE DRAWINGS

The characteristics and advantage of this invention will become more apparent by describing the preferred embodiments thereof with reference to the accompanying drawings, in which.

DETAILED DESCRIPTION OF THE PREFERRED EMBODIMENTS

According to the present invention, the door D of the microwave oven having an additional heating source such as lighting lamps is opened and closed by the driving motor. The opening of door D is delayed for a predetermined time by the driving motor.

Figure 1:
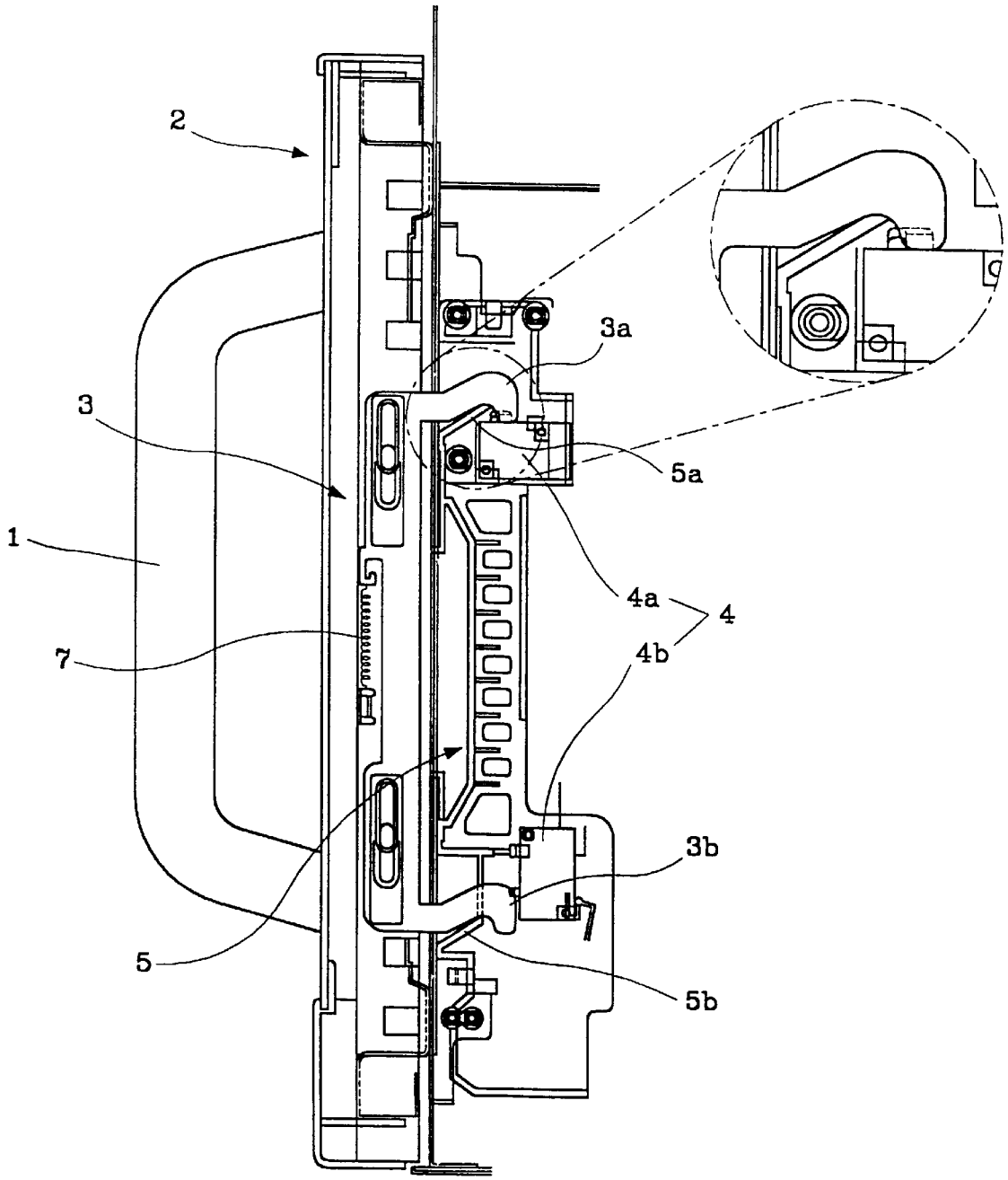
FIG. 1 CONVENTIONAL ART
FIG. 1 is a cross section view of the conventional opening and closing mechanism of the microwave oven door.
Figure 2:
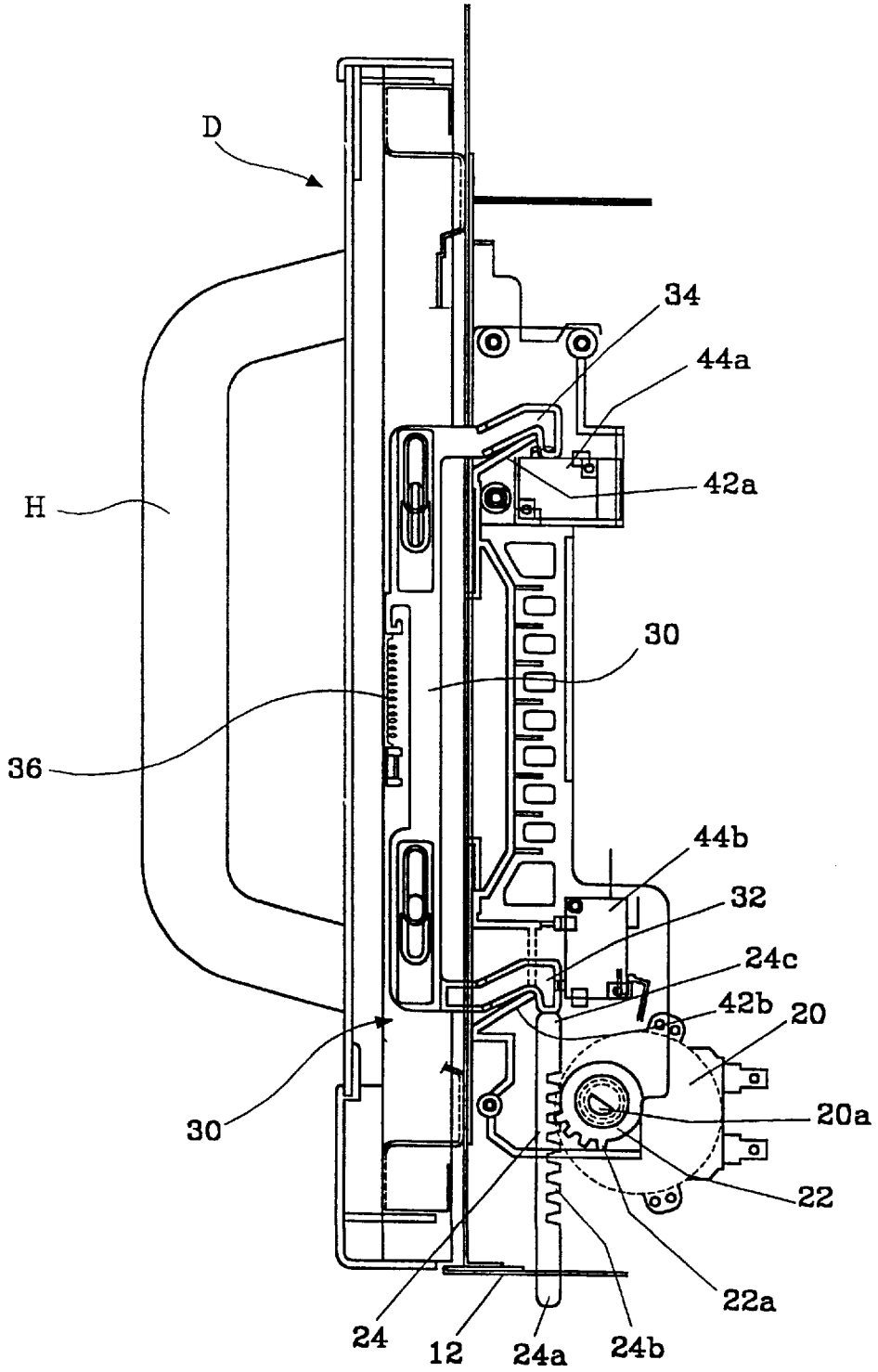
FIG. 2 is a cross section view to show an operation of the door when it is closed according to the present invention.

FIG. 2 illustrates an opening and closing mechanism for the door D when the door D is closed. As seen in FIG. 2, the mechanism includes a driving motor 20, the opening and closing lever 24 moving up and down by the driving motor 20, and the latch member 30 releasing the door using the opening and closing lever 24.

The driving motor 20 generates power to open the door D. A driving gear 22 is mounted on the rotating shaft 20*a* of the driving motor 20. The driving gear 22 is rotated clockwise by the driving motor 20 when the door D is opened. The driving gear 22 has teeth 22*a* on its circumference, which moves the opening and closing lever 24 upward and downward by transmitting the rotation force of the motor 20.

The opening and closing lever 24 has a rack 24*b* engaged with the teeth 22*a* of the driving gear 22. When the driving gear 22 rotates, it moves the opening and closing lever 24 up and down. For example, when the driving gear 22 is rotated clockwise, the opening and closing lever 24 moves upward, and when the driving gear 22 is rotated counterclockwise, the opening and closing lever 24 moves downward.

The lower part 24*a* of the opening and closing lever 24 protrudes downward beyond the bottom surface 12 of the microwave oven. This permits the opening and closing lever 24 to be manually operated when the driving motor 20 cannot be driven due to the power failure etc.

The latch member 30 is elastically biased on the door D downward by a spring 36. The latch hooks 32, 34 are formed in the upper inner side and in the lower inner side in the latch member 30, respectively. When the door D is closed, the latch hooks 32, 34 keeps the door D locked to the lockers 42*a*, 42*b* formed in the main body of the microwave oven. When the latch hooks 32, 34 are engaged with the lockers 42*a*, 43*b*, respectively, the door may not be unlocked arbitrarily even when the user pulls the handle H of the door D. Therefore, if the latch member 30 does not move up, the locked state between the latches 32, 34 and the lockers 42*a*, 42*b* is maintained continuously, according to the present invention.

The lower end of the lower latch hook 32 contacts the upper part 24*c* of the opening and closing lever 24. Accordingly, when the opening and closing lever 24 moves upward, the locked state between the latch hooks 32, 34 and the lockers 42*a*, 42*b* are released, and then the door D can be opened.

A pair of door micro switches 44*a*, 44*b* are mounted adjacent to the locker 42*a*, 42*b* formed in front of the main body of the microwave oven. When the door D is closed, the latch hooks 32, 34 contact the door switches 44*a*, 44*b* so that the switches are on, thereby supplying current to the microwave oven. When the door is opened, the latch hooks 32, 34 are detached from the door switch 44*a*, 44*b*, so that the door switches 44*a*, 44*b* are off and current cannot be supplied to the microwave oven.

Figure 3:
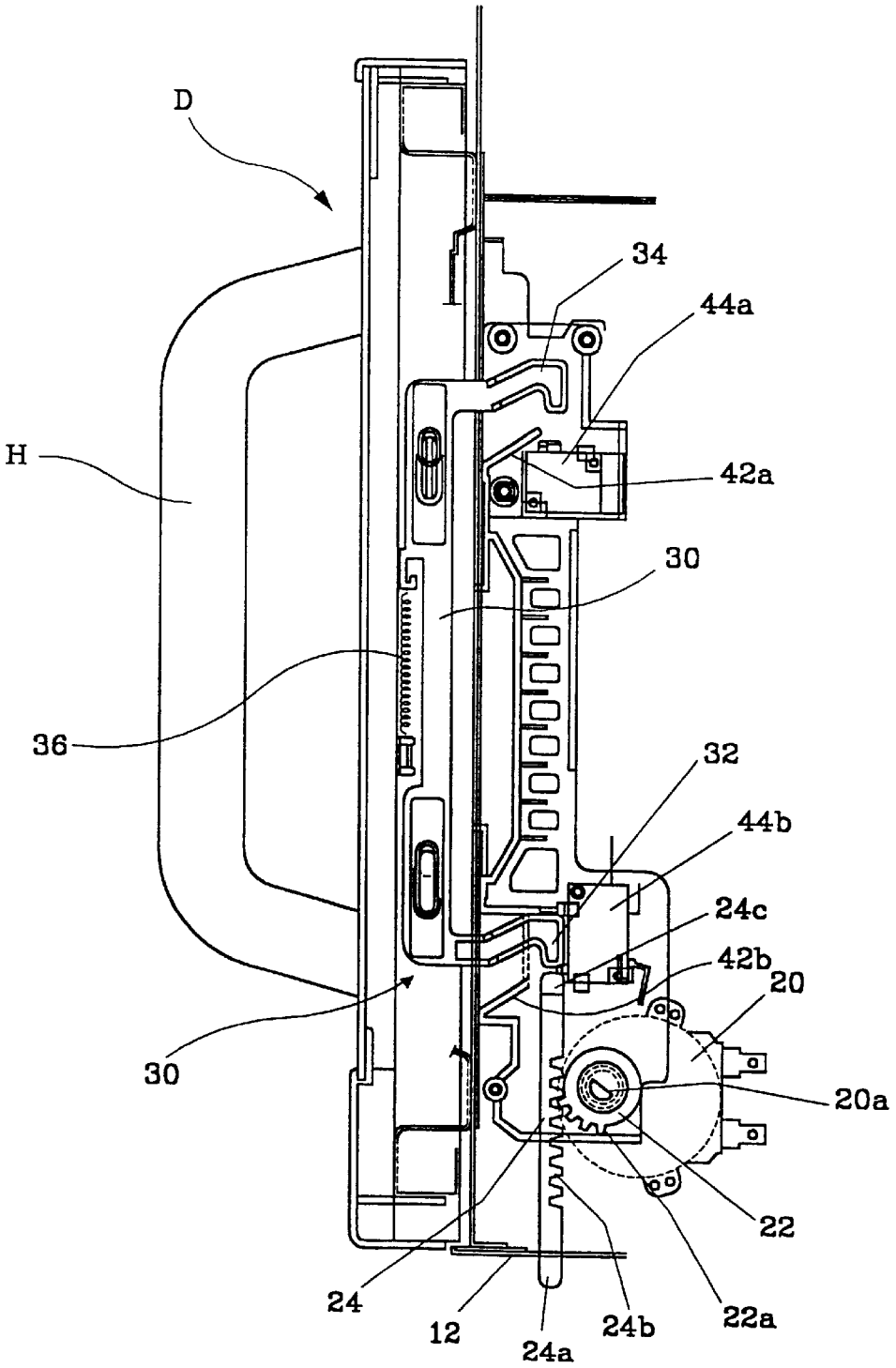
FIG. 3 is a cross section view to explain an operation of the door when it is opened according to the present invention.

Next, based on the structure of this invention, as mentioned above, the opening and closing operation of the door D is described referring to FIG. 3. According to the present invention, the door D is opened by the operation of the driving motor 20. And the control of the driving motor 20 will be achieved, for example, by pressing the operation button (not shown) which is arranged in front of the microwave oven and sends a signal to open door D to a microprocessor installed inside of the microwave oven.

The operation of opening the door D is carried out by the signals generated when the operation button is pressed. Of course, in case of a power failure, the door D can be opened manually by the user by depressing protruding end 24*a*.

When the user presses the operation button, the driving motor 20 rotates clockwise so that driving gear 22 rotates clockwise. The opening and closing lever 24 having the rack 24*b* which is engaged with the teeth portion 22*a* moves upward by the rotation of the driving gear 22.

As the opening and closing lever 24 moves upward, the upper part 24*c* moves the latch member 30 upward. The latch member 30 moves upwards by a bigger force than resilient force of the spring 36. The latch hook 32, 34 formed at the upper side and lower side also move upward to disengage from the lockers 42*a*, 42*b* of the main body of the microwave oven. As a result, the door switches 44*a*, 44*b* are opened and the supply of the electricity inside of the microwave oven is cut off.

In this way, the latch hooks 32, 34 and the lockers 42*a*, 42*b* are released and the door D is opened so that the user can open the door of the microwave oven by pulling the handle H.

When the user wants to open the door during a power failure, the lower part 24*a* of the opening and closing lever 24 which protrudes downward from the bottom surface 12 of the microwave oven is pushed upward by the user. The opening and closing lever 24 then moves upward so that the door D can be opened in the same manner by the driving motor 20.

As stated above, according to the present invention, the opening and closing for the door D is operated by the driving motor 20. Therefore, it takes a predetermined time, for example, two or three seconds, to open the door D after the switches 44*a*, 44*b* are off. The door D can be opened only after the opening and closing lever 24 completely moves upward by the driving gear 22 which is rotated by the driving motor 20. The delayed time means a time that the opening and closing lever 24 shifts upward by the rotation of the driving gear 22.

The delayed time resulting from the driving mechanism may be adjustable depending on the rotating speed of the motor 20 and the number of teeth of the driving gear 22. Also, if necessary, it is possible to install a deceleration device between the driving motor 20 and the driving gear 22. For example, a gear train may be installed between the driving motor 20 and the driving gear 22 for decelerating the rotation of the driving gear 22, thereby reducing the shifting speed of the opening and closing lever 24 to open the door D more slowly.

Therefore, in the microwave oven using lighting lamps as another heating source, it is possible to prevent damage to the user's sight by the remaining light of the lighting lamps.

The delaying time is obtained by transmitting the rotation of the driving motor through the gear and rack. So, when the door is opened, the remaining light of the lighting lamps inside of the microwave oven are completely extinguished.

The microwave oven according to the present invention can provide more various cooking quality by using lighting lamps as another hearing source. At the same time, the door D of the microwave oven is opened, not by the physical force of the user, but by the user's simple operation such as the operation button. Therefore, more advantages to further improve the convenience of the door handling can be achieved.

The principles of the preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. In an oven including both heating lamps and a magnetron for generating microwave energy, a door latching mechanism comprising:

a locking mechanism for selectively locking a door of the oven closed;

a release mechanism for selectively unlocking the door of the oven so that the door is openable; and a delay mechanism for delaying operation of said release mechanism for a sufficient amount of time so that the heating lamps in the oven are extinguished before the door is openable.

2. The mechanism according to claim 1, further comprising a switch mechanism for cutting off power to the magnetron when the door is unlocked by said release mechanism.

3. The mechanism according to claim 1, wherein said locking mechanism comprises:

a moveable latch mounted on the door, and a locker provided on a front of the oven, wherein said latch includes a latch hook constructed and arranged to be engageable with said locker when the door is closed, said latch being resiliently biased towards a position in which said latch hook is engaged with said locker.

4. The mechanism according to claim 3, wherein said release mechanism comprises a movable rack constructed and arranged to selectively displace said latch so that said latch hook disengages from said locker.

5. The mechanism according to claim 3, wherein said locking mechanism comprises upper and lower lockers provided on the front of the oven, and said latch includes upper and lower latch hooks constructed and arranged to be engageable with said upper and lower lockers, respectively, when the door is closed.

6. The mechanism according to claim 4, wherein said delaying mechanism comprises:

a driving motor; and a power transmission for transmitting power from said driving motor to said rack, such that said rack is displaceable.

7. The mechanism according to claim 6, wherein said power transmission comprises a driving gear driven by said driving motor, said driving gear being operably engaged with said rack.

8. The mechanism according to claim 7, wherein said power transmission comprises a gear train operably intermediate said driving gear and said rack.

9. The mechanism according to claim 3, further comprising a switch mechanism constructed and arranged to be on when said latch hook is engaged with said locker, and to be off when said latch hook is disengaged from said locker.

10. The mechanism according to claim 5, further comprising a switch mechanism including a pair of switch elements connected in parallel, said switch mechanism being constructed and arranged to be on when said upper and lower latch hooks are engaged with said upper and lower lockers, respectively, and to be off when said upper and lower latch hooks are disengaged from said upper and lower lockers, respectively.

* * * * *